United States Patent [19]

Drewett

[11] 4,160,979

[45] Jul. 10, 1979

[54] HELICAL RADIO ANTENNAE

[75] Inventor: Robert J. Drewett, Swindon, England

[73] Assignee: National Research Development Corporation, London, England

[21] Appl. No.: 808,384

[22] Filed: Jun. 20, 1977

[30] Foreign Application Priority Data

Jun. 21, 1976 [GB] United Kingdom ..... 25727/76
Apr. 1, 1977 [GB] United Kingdom ..... 13928/77

[51] Int. Cl.[2] ..... H01Q 1/36
[52] U.S. Cl. ..... 343/788; 343/895
[58] Field of Search ..... 343/806, 895, 788

[56] References Cited

U.S. PATENT DOCUMENTS

| | | | |
|---|---|---|---|
| 1,495,537 | 5/1924 | Stafford | 343/895 |
| 2,401,882 | 6/1946 | Polydoroff | 343/788 |
| 3,689,929 | 9/1972 | Moody | 343/806 |
| 3,965,474 | 6/1976 | Guerrino et al. | 343/788 |

FOREIGN PATENT DOCUMENTS

| | | | |
|---|---|---|---|
| 1260103 | 3/1961 | France | 343/895 |
| 1337276 | 8/1963 | France | 343/895 |
| 1896769 | 12/1965 | Japan | 343/895 |

*Primary Examiner*—Eli Lieberman
*Attorney, Agent, or Firm*—Cushman, Darby & Cushman

[57] ABSTRACT

Compact radio antennae are disclosed which comprise an extended conductor, such as a wire, arranged to form an elongated structure. The conductor is arranged in a plurality of windings comprising windings of opposite senses positioned coaxially in proximate relation. In one form the conductor is arranged in a series of helical windings all coaxial, to form a cylindrical structure, and successive windings in the series are alternately left-handed and right-handed. In another form the conductor is arranged in a first helical winding forming a cylindrical structure and a second helical winding of opposite chirality to the first, but with the same number of turns and longitudinal extent and coaxial with it. A flux-concentrating core may be longitudinally disposed within the cylindrical structure. Antennae are particularly described for the HF, VHF and UHF bands.

1 Claim, 11 Drawing Figures

HELICAL RADIO ANTENNAE

This invention relates to radio antennae.

Portable radio sets operating in the VHF frequency band, such as walkie-talkie transceivers and domestic VHF receivers, generally use a whip type of aerial as antenna. While a VHF whip aerial is electrically satisfactory it is physically inconvenient because of its length and vulnerability to damage when extended. Since many VHF transmissions, particularly those intended for domestic reception, are horizontally polarised, whip aerials have to be extended almost horizontally to receive these transmissions, and this further aggravates the inconvenience already inherent in the length of the aerial. The awkward length and vulnerability of VHF whip aerials is particularly inconvenient for members of fire-fighting, police and other security services who may need to keep their radio equipment operating while moving quickly within buildings or in other congested situations.

The UHF frequency band is commonly used for public television transmissions, and while, because of the shorter wavelength, conventional UHF dipole or monopole antennae are resonably compact, the recent development of small portable television receivers makes it desirable to have a more compact UHF antenna.

Whip aerials for use in the HF band are known and are generally even larger and more unwieldy than VHF whip aerials. Helical HF whip aerials are more compact, but they suffer from low band width and strong multiple resonances up to a high order.

According to the present invention there is provided a radio antenna comprising an extended conductor arranged to form an elongated structure, the said conductor being disposed in a plurality of windings comprising windings of opposite senses and of substantially equal numbers of turns arranged coaxially in proximate relation.

The windings may be spiral and arranged in coaxial pairs, with the windings of one pair not necessarily coaxial with the windings of another pair. Preferably, however, the windings are also arranged coaxially to form a cylindrical structure and preferably the windings are helical.

In one form of the invention the windings form a series extending along the length of the structure, successive windings in the series being adjacent and of opposite sense. The windings then may be of a fractional number of turns, but preferably comprise one or more turns. An approximately integral number of turns is convenient and about one turn is particularly so, since with just one turn per winding, if the turns are wound closely, the windings in the series can be brought close together, thus increasing the interaction between adjacent windings.

The windings may be coupled to a flux-concentrating core which may be of soft ferromagnetic material, material of high dielectric constant, a non-magnetic conductor or a suitable combination. In the case of a cylindrical structure the core may conveniently be longitudinally disposed within the structure.

In another form of the invention the windings comprise a first helical winding extending along the length of the structure and a second helical winding extending along the length of the structure, the first and second windings having approximately the same number of turns as each other but in the oppposite sense.

The antenna according to the invention can be connected into a circuit in the same way as a conventional monopole antenna. That is to say it may be connected by means of a tapping connection or directly at one end. It is found in practice that antennae according to the invention can be made which present suitable impedances for matching to connections made at the end, without any need for tapping connections.

The arrangement of the conductor is such that a resonant antenna according to the invention is physically shorter than a conventional whip antenna resonant at the same frequency. The coupling of the conductor with the core tends further to reduce the necessary length of the antenna. Antennae according to the invention have been found to have a somewhat lower gain than conventional whip antenna, but it has been found that a single extra radio-frequency amplification stage will adequately compensate for this. It is considered that the advantages of compactness and robustness possessed by the antennae herein described outweigh the disadvantage of the lower gain.

It appears that the antennae herein described have the additional advantage that their performance is less sensitive to the proximity of other objects such as walls, furniture, vehicle bodywork or human bodies than conventional whip aerials.

Within the scope of the present invention there is included a radio antenna having a resonant frequency in the VHF band, and comprising an extended conductor, one end of which is an open-circuit end and the other end of which forms an electrical connection to the antenna, forming a series of groups of turns around and disposed along the length of a core formed from a conducting material or a magnetically soft ferromagnetic material, successive groups in the series being wound in left-hand and right-hand senses alternately.

The core may consist of beads of ferrite or like material to impart a degree of flexibility to the antenna.

It will be appreciated that the windings in antennae according to the invention are so arranged that axial magnetic fields through the windings due to electric currents in the windings substantially cancel.

Antennae according to the invention may be combined to form dipole antennae, but where compactness is particularly required a monopole antenna is generally more convenient.

Some embodiments of the invention will now be described by way of example with reference to the accompanying drawings of which:

Figure 5:
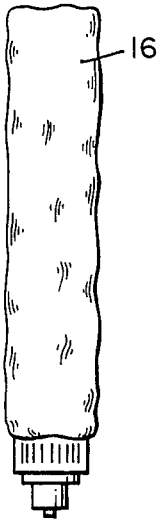
Figure 6:
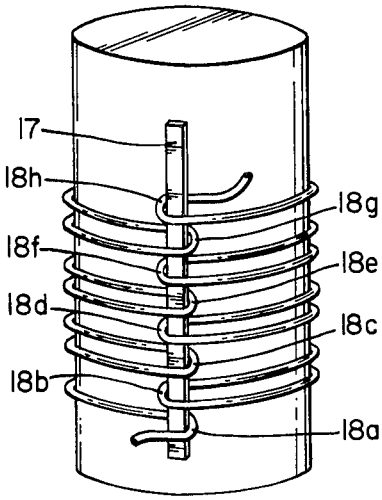
Figure 7:
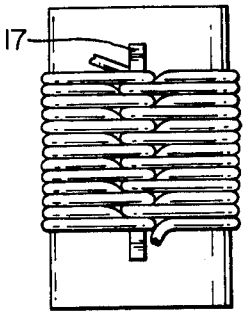
Figure 8:
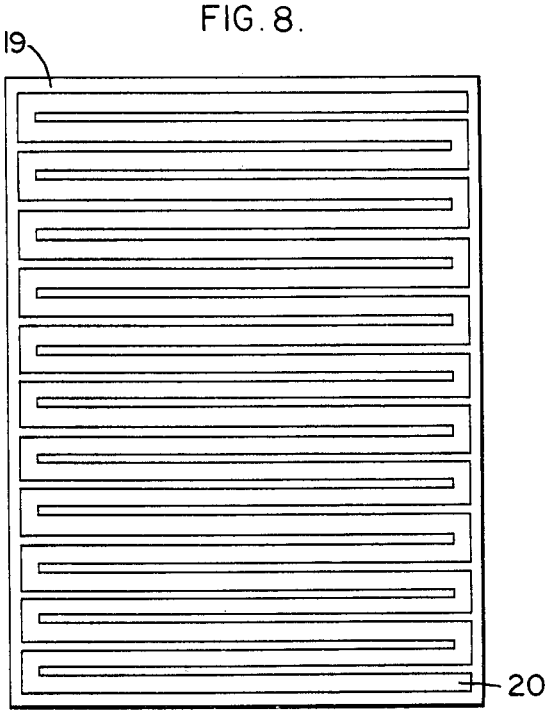
Figure 9:
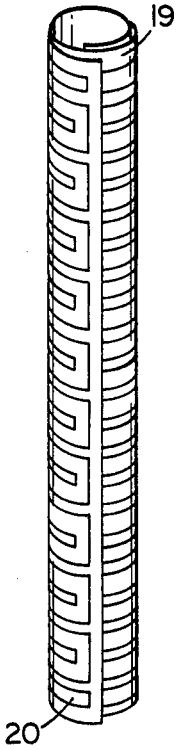
Figure 10:
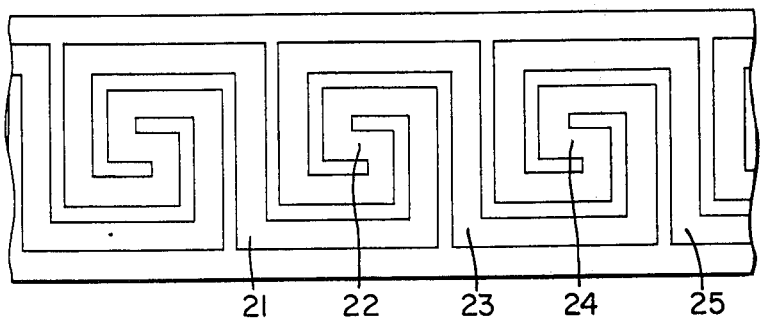
Figure 11:
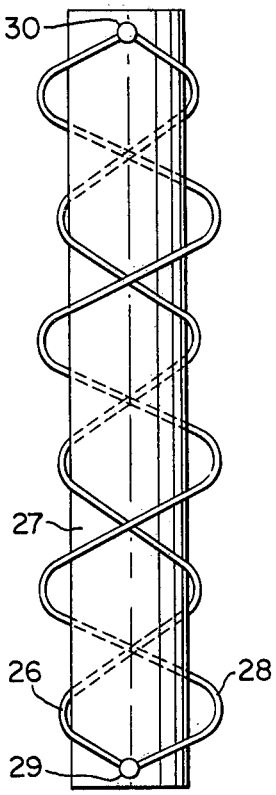

FIG. 5 shows an antenna according to the invention with a dielectric coating, FIGS. 6 and 7 illustrate a mode of construction of antennae according to the invention using a wire conductor, FIGS. 8 and 9 illustrate an alternative mode of construction using a printed conductor, FIG. 10 shows an alternative form which the windings may take, and FIG. 11 illustrates an antenna according to the invention.

Figure 1:
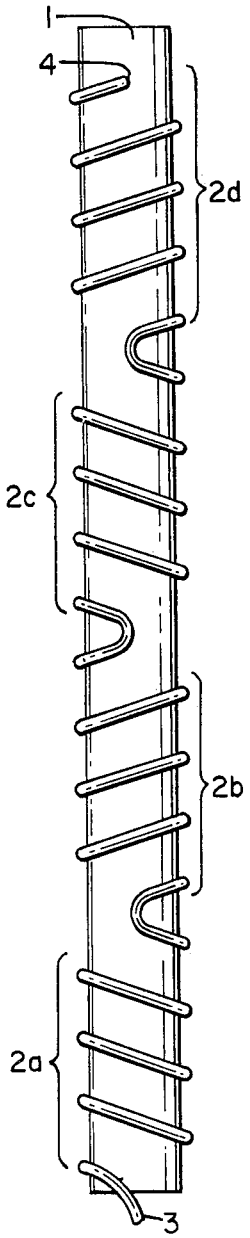
FIG. 1 shows a radio antenna according to the present invention.

In FIG. 1 a ferrite rod 1 has a length of enamelled copper wire wound round it in four groups of turns, *2a*, *2b*, *2c* and *2d*. The groups 2 are evenly spaced along the length of the rod 1. The group *2a* consists of four turns in the left-hand sense; the group *2b* consists of four turns in the right-hand sense; the group *2c* consists of four turns in the left-hand sense; and the group *2d* consists of four turns in the right-hand sense. One end of the wire 3, provides an electrical connection for the antenna, and the other end 4, is an open circuit end.

The antenna acts as a quarter wave monopole at a frequency in the VHF band. In order to obtain an antenna tuned to a desired frequency, wire is wound round the rod 1, forming more groups of turns than is necessary, and the resonant frequency is gradually increased by successively clipping off turns from the open circuit end 4 of the wire. When the desired resonant frequency is nearly reached the turns are stretched out to fill the length of the rod 1, whereupon the resonant frequency falls a little.

One such antenna which has been tested, is wound on a ferrite rod 200 mm (9 inches) long and comprises four groups each of four turns, as shown in the Figure. Another antenna which has been tested is wound on a ferrite rod 130 mm long (5 inches). A 200 mm antenna has a bandwidth of about 5 MHz, and has been tried at an operating frequency of 79 MHz on a portable walkie-talkie transceiver. The 130 mm antenna has a similar bandwidth and has been tested on a portable VHF radio receiver using BBC transmissions (about 94 MHz). When tested in the laboratory over a large ground plane, or when mounted on the top of a vehicle, so that the top of the vehicle forms a large ground plane, the antennae according to the invention show a markedly lower gain than a whip aerial adapted to work at the same frequency, and standing over a large ground plane. In subjective tests, however, using portable radio apparatus, in which there is no large ground plane, the antennae according to the invention gave apparently comparable performance with a whip aerial. The sensitivity is definitely lower than with a whip aerial, but it is found that a single extra stage of radio frequency amplification is enough to make the performance subjectively very similar. The ferrite rods used were salvaged from old longwave/medium wave radio receivers and were thus not specially adapted for use at VHF frequencies. An antenna has been tested using a core of dustiron, thought to be better adapted for use at VHF frequencies, but the performance was not apparently better than with a ferrite core. An antenna has also been tried using an aluminium tube, of the type used in building dipole antennae of a conventional type, in place of the ferrite rod 1. This antenna worked, but was rather less satisfactory than the ferrite antenna.

Figure 2:
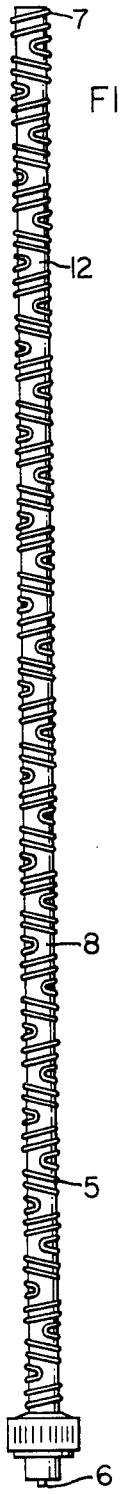
FIG. 2 shows a semi-flexible antenna according to the invention.
Figure 3:
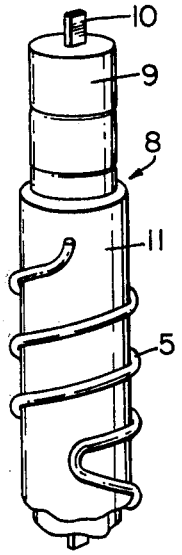
FIG. 3 shows a cutaway view of a portion of the antenna FIG. 2.

In the antenna illustrated in FIGS. 2 and 3 the conductor consists of thirty-three groups, each of three turns, of enamelled copper wire 5. One end of the wire is connected to the central electrode of a coaxial connector 6 (FIG. 2 only). The other end of the wire 7 is an open circuit end. The core 8 consists of ferrite beads 9 (FIG. 3 only) of the type commonly used as parasitic suppressors (Q-killers) threaded on a strip of fibreglass 10 (FIG. 3 only). The beads are covered by a heat-shrink sleeving to provide protection and added mechanical support. The core 8 extends for only two thirds of the length of the antenna, its place being taken for the third of the length nearest to the open circuit end 7 by a length of plastic tubing 12 whose sole purpose is to provide mechanical support for the windings. The length of the antenna is about 250 mm (10 inches) and the diameter is about 6 mm (¼ inch). The antenna of FIG. 2 has been tested with a portable VHF receiver using BBC VHF transmissions (about 90 MHz). The performance was comparable with, but noticeably less good than the telescopic aerial supplied with the set, but with a single extra stage of radio frequency amplification, subjectively similar performance was obtained. An antenna similar to that of FIG. 2 has been built and made to resonate at 450 MHz. This antenna had fourteen groups, each of one turn, and the length of the antenna was 65 mm (2½ inches) of which the core only extended for 40 mm (1½ inches). The antenna of FIG. 2 has quite marked directional properties, and it is notable that in this respect it resembles a rod monopole aerial. It is thus clear that the antenna of FIG. 2 is acting as a monopole antenna, rather than as a magnetic pick-up which conventional ferrite rod aerials are.

Figure 4:
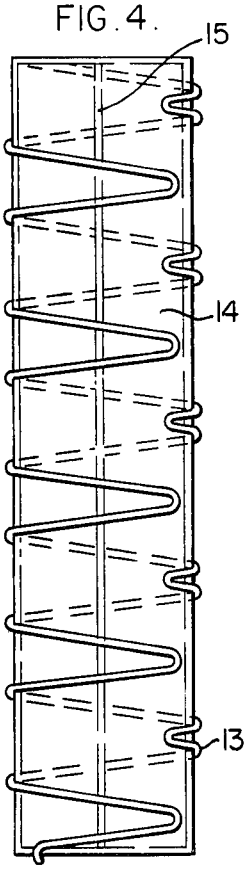
FIG. 4 shows an antenna according to the invention with a dielectric core.

In the antenna of FIG. 4 the conductor 13 is disposed in ten groups, each of one turn, wound alternately in the left-hand and right-hand senses. The core is a dielectric core 14 consisting of distilled water contained in a cylindrical plastics container. A conducting copper wire 15 runs through the axis of the core from one end to the other. The antenna will work without the conductor 15, but the insertion of the conductor 15 lowers the resonant frequency of the antenna, or, for the same frequency, reduces the length of the antenna. The antenna is about 130 mm (5 inches) in length by about 30 mm (about 1¼ inches) in diameter. It has been tested with a portable VHF receiver using BBC broadcasts. The electrical connection is to one end of the conductor 13, the central conductor 15 being left floating.

FIG. 5 shows an antenna with a ferrite core, of a similar type to the antenna of FIG. 1, coated with Plasticine (the word Plasticine is a trademark of Harbutt's Plasticine Ltd). The Plasticine 16 is pressed into the antenna, filling in the air spaces between the turns. The Plasticine acts as a dielectric and lowers the resonant frequency of the antenna, or, for the same resonant frequency, reduces the necessary size of the antenna.

In the antennae thus far described there are loops of wire formed where the conductor turns back on itself between groups of turns. These loops of wire are vulnerable to displacement unless secured in place, and give rise to difficulties in production, especially where many groups of turns are required. In the mode of construction illustrated in FIG. 6 a fibreglass strip 17 extends axially along the length of the antenna and the loops 18*a* to 18*h* are formed round the strip 17. The strip 17 thus serves to hold the loops 18 in place and also acts as a guide in making the loops, enabling them to be made neatly in line. In FIG. 7 is shown a section of an antenna constructed in the mode illustrated in FIG. 6 in which the windings are closed up together so that there is virtually no air space between adjacent windings. With antennae according to the invention which do not have any core, it is advantageous that the windings should be as close to one another as possible. In these circumstances the strip 17 is of particular usefulness because there are many loops and they are close together.

An alternative mode of construction is illustrated in FIGS. 8 and 9. FIG. 8 shows a rectangular sheet of flexible insulating material 19 on which is printed a serpentine conducting strip 20. In FIG. 9 the sheet 19 is shown rolled into a cylinder so that the conducting strip 20 is formed into a series of windings of alternating sense, thus forming an antenna according to the invention. As illustrated in FIG. 9 the windings are each of about two turns, but clearly the windings can be made with any desired number of turns by rolling the sheet more or less tightly.

In all the antennae described so far the axes of the windings have been parallel to the general direction of extension of the antenna. In FIG. 10 is illustrated a form of winding in which the axis of the windings are at right angles to the general direction of extension. As illustrated in FIG. 10 the general direction of extension of the conductor is from left to right. From a point 21 the conductor spirals inwards anti-clockwise to a point 22 and then spirals outwards to a point 23 which is displaced from the point 21 in the general direction of extension of the conductor. From the point 23 the conductor again spirals inwards to a point 24 and then outwards again to a point 25, and so on, repeating the same pattern to form a series of double spirals extending in the general direction of extension of the conductor. In this form of conductor the anti-clockwise spiral from 21 to 22 is one winding and the clockwise spiral from 22 to 23 is the next. The next anti-clockwise spiral from 23 to 24 is the next winding and the clockwise outward spiral from 24 to 25 is the next after that. Thus the conductor forms a series of windings, successive windings in the series being adjacent and of opposite sense.

In field tests of a ferrite cored antenna of the type illustrated in FIG. 1 using walkie-talkie transceivers operating at 79 MHz it was reported that the antenna worked particularly well, compared with conventional whip aerials, in an indoor location and aboard vehicles. It is thought that this may be partly due to the physical convenience of having a compact antenna in confined spaces. This is particularly so within vehicles where the whip aerial normally used had to be pushed out through a window in order to make room for the occupants of the vehicle to ride in any comfort. It is also, however, thought to be partly due to the smaller near field of the antennae according to the invention, compared with whip aerials, which makes the antennae according to the invention less vulnerable to so-called proximity effects, by which conventional whip aerials are pulled out of tune by the presence of nearby objects.

FIG. 11 shows schematically a further antenna according to the invention. A first helical winding 26 of insulated copper wire is wound around a cylindrical former 27. A second helical winding 28 of insulated copper wire is wound over the first winding 26. The two windings 26 and 28 are joined together at one end, 29, which forms the connection to the antenna, so they effectively constitute a single conductor. As illustrated the windings 26 and 28 are also joined together at the other end 30. This is convenient since it helps to prevent the windings from coming unwound, but it makes practically no difference to the operation of the antenna. The windings 26 and 28 are coaxial, have the same longitudinal extent and number of turns but are wound in the opposite sense, the first winding 26 being illustrated as left-handed and the second winding 28 as right-handed.

For the sake of clarity the windings are shown loosely wound and the second winding 28 is shown standing out well clear of the first winding 26. Also only a small number of turns are shown. In an embodiment of the antenna which has been built and tested the windings 26 and 28 were closely wound, leaving substantially no gaps between turns, and the second winding 28 was wound directly over the first winding 26, with substantially no space between them. The antenna measured two meters in length and 25 mm in diameter and the windings were closely wound in 32 gauge wire. The antenna was resonant at 7.4 megahertz (in the HF band) with a bandwidth of about 2.5 megahertz. The impedance at the point 29 was about 200 ohms, which could easily be matched to 50 ohm equipment by means of a small autotransformer. For comparison a helical whip antenna resonant at 7.4 megahertz of similar dimensions was made. The bandwidth of the helical whip antenna was only about 250 kilohertz and there were strong multiple resonances. The antenna according to the invention had a fairly strong half-wave resonance at 15 megahertz, but no strong higher resonances.

An HF Antenna resonant at 7.4 megahertz has also been built using the mode of construction illustrated in FIGS. 6 and 7. The antenna was one meter long and 65 mm in diameter and comprised a series of windings, each of one turn, closely wound in 32 gauge wire. The performance was similar to that of the antenna constructed as illustrated in FIG. 11, but the amount of labour involved in making the windings was much greater.

The illustrated embodiments of the invention are not intended to provide an exhaustive catalogue of possible embodiments, and a person skilled in the relevant art will be able to produce others. For example the antennae can be made shorter and wider, and other core materials can be used. For example, distilled water was used as a dielectric because of its easy availability and convenience in a laboratory context, but for practical production purposes, other known dielectrics may well be more convenient and more effective. For example, rutile type dielectrics are known which have higher dielectric constants than water at VHF frequencies and have very low losses. Also titanate ferro-electric dielectric materials have very high dielectric constants, but they have comparatively high losses, and their properties are temperature dependent to an undesirable degree.

I claim:

1. An end fed radio antenna comprising a flux-concentrating rod and an extended conductor having an electrical length of one quarter of the design wavelength, said conductor forming a series of insulated coaxial, helical windings of plural turns about said rod, said windings being separated from each other along the length of said rod, adjacent windings reversing the direction of winding and having opposite sense, each winding having the same given number of turns with the turns separated from each other.

* * * * *